US006088851A

United States Patent [19]

Draheim

[11] Patent Number: 6,088,851

[45] Date of Patent: Jul. 18, 2000

[54] CRIB DROPSIDE ASSEMBLY INCLUDING RAIL END FITTINGS FOR ENGAGING AND SHEILDING CORNER POSTS TRACKS

[75] Inventor: Harvey J. Draheim, Weyauwega, Wis.

[73] Assignee: Simmons Juvenile Products Company, Inc., New London, Wis.

[21] Appl. No.: 08/851,693

[22] Filed: May 6, 1997

[51] Int. Cl.[7] ..... A47D 7/02

[52] U.S. Cl. ..... 5/100; 5/93.1; 5/1

[58] Field of Search ..... 5/93.1, 100, 428

[56] References Cited

U.S. PATENT DOCUMENTS

| | | | |
|---|---|---|---|
| 3,634,894 | 1/1972 | Harbison | 5/93.1 |
| 3,900,907 | 8/1975 | Mulder | 5/93.1 |
| 4,703,524 | 11/1987 | Brunner et al. | 5/100 |
| 4,724,556 | 2/1988 | Burnham | 5/100 |
| 4,768,243 | 9/1988 | Waples . | |
| 5,072,464 | 12/1991 | Draheim et al. . | |
| 5,327,594 | 7/1994 | Sun | 5/100 |
| 5,432,962 | 7/1995 | Huang | 5/100 |

*Primary Examiner*—Terry Lee Melius
*Assistant Examiner*—F Conley
*Attorney, Agent, or Firm*—Hoffmann & Baron, LLP

[57] ABSTRACT

A crib dropside assembly is provided which includes a pair of end fittings that eliminate the gaps which ordinarily are found between the top rail of the crib dropside and the corner posts of the crib. Each end fitting includes a base portion which is secured to the bottom side of the top rail of the crib dropside and a shield which is coupled to the base portion. The shield engages the inner surface of a corner post in such a manner that there is substantially no gap between the end fitting and the corner post. The shield also defines an enclosure which contains all or part of a track engagement member. The track engagement member is coupled to a track located on the corner post. By eliminating the gaps between the top rail and corner posts as described above, the possibility of clothing or bedding materials being caught between these elements is greatly reduced.

14 Claims, 5 Drawing Sheets

CRIB DROPSIDE ASSEMBLY INCLUDING RAIL END FITTINGS FOR ENGAGING AND SHEILDING CORNER POSTS TRACKS

BACKGROUND OF THE INVENTION

1. Field of the Invention

The field of the invention relates to crib dropside assemblies, and particularly to assemblies including dropsides movably mounted to corner posts by rail end fittings.

2. Brief Description of the Prior Art

Crib dropside assemblies are employed for allowing one of the sides of a crib to be raised or lowered. Access to an infant is thereby facilitated. U.S. Pat. Nos. 4,768,243, 4,951,330 and 5,072,464 disclose cribs having such assemblies.

Certain types of crib dropside assemblies include tracks mounted to the corner posts of a crib. The exposed portions of the tracks include relatively flat rails which run parallel to the corner posts. The upper cross rail of the dropside of such assemblies includes a pair of end fittings which slidably engage the tracks. The end fittings are made from plastic, and include a pair of opposing arms having inwardly extending portions. Each track is slidably engaged by these arms. FIG. 8 shows the prior art assembly described above, while FIG. 7 shows an end fitting of the type used in such an assembly.

While the prior art dropside assemblies function satisfactorily in raising and lowering the dropside, there are gaps between the end fittings and the corner posts of the crib in which clothing and/or bedding can become caught. This can create an inconvenience whether the dropside is being operated or not.

SUMMARY OF THE INVENTION

A crib dropside assembly is provided which eliminates the gaps found in many prior art assemblies between the end fittings on the upper rail of the dropside and the corner posts of the crib. The assembly includes a corner post and a dropside movably mounted to the corner post, the dropside including an upper rail, a lower rail. An end fitting is mounted to an end of the upper rail of the dropside. The end fitting includes a track engagement member, preferably in the form of a pair of projections or arms extending inwardly from a shielding member of the end fitting. A track is coupled to the corner post. The track engagement member is slidably mounted to the track. The shielding member adjoins the corner post such that substantially no gap is present between the end fitting and corner post.

The end fitting according to the invention includes a base and a shield extending from the base. The shield includes a first wall coupled to the base and a pair of opposing walls coupled to the first wall. First and second projections extend within the channel from the opposing walls of the shield. The projections are in opposing relation and are located between the inner and outer ends of the opposing walls.

DETAILED DESCRIPTION OF THE INVENTION

Figure 1:
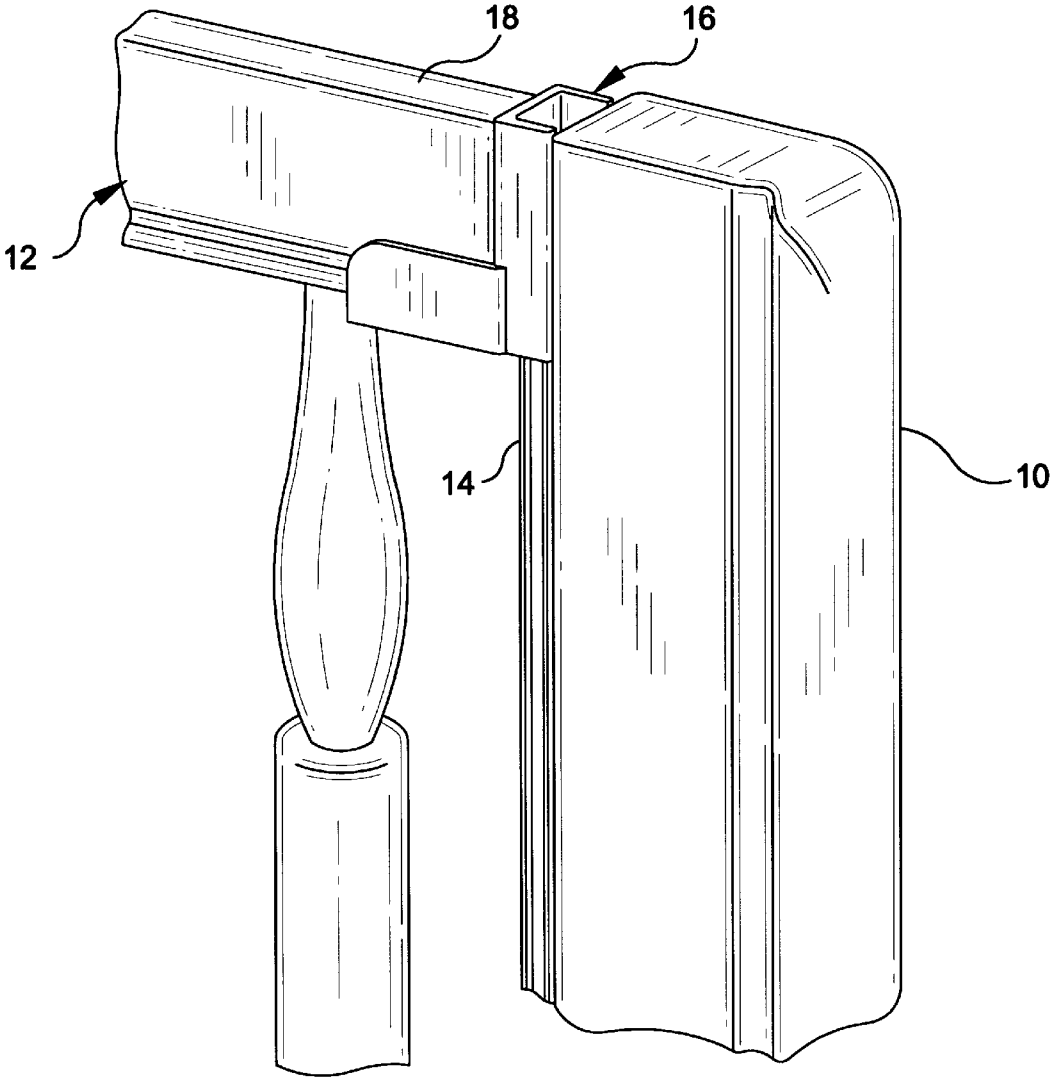
FIG. 1 is a perspective view showing a crib dropside assembly according to the invention.

A crib dropside assembly is provided for facilitating access to the interior of a crib or other such furniture item. Referring to FIG. 1, the assembly is comprised of first and second corner posts 10, one of which is shown, a dropside 12, and tracks 14 mounted to the corner posts.

While the invention described herein would have applicability to various existing dropside assemblies, it is shown as incorporated with an assembly including tracks of the type including a flat rail secured to and running parallel to the inner portion of a corner post. End fittings 16 are secured to the opposite ends of the upper rail 18 of the dropside 12. The assembly further includes lower tracks (not shown) which are engaged by a second pair of end fittings secured to the lower cross rail of the dropside. The second pair of end fittings can be uncoupled from the lower tracks in a conventional manner to allow the dropside to be moved between raised and lowered positions.

Figure 7:
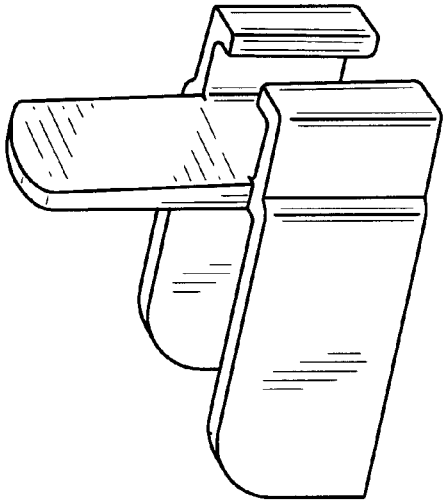
FIG-7 PRIOR ART
FIG. 7 is a top perspective view of an end fitting known to the art.
Figure 6:
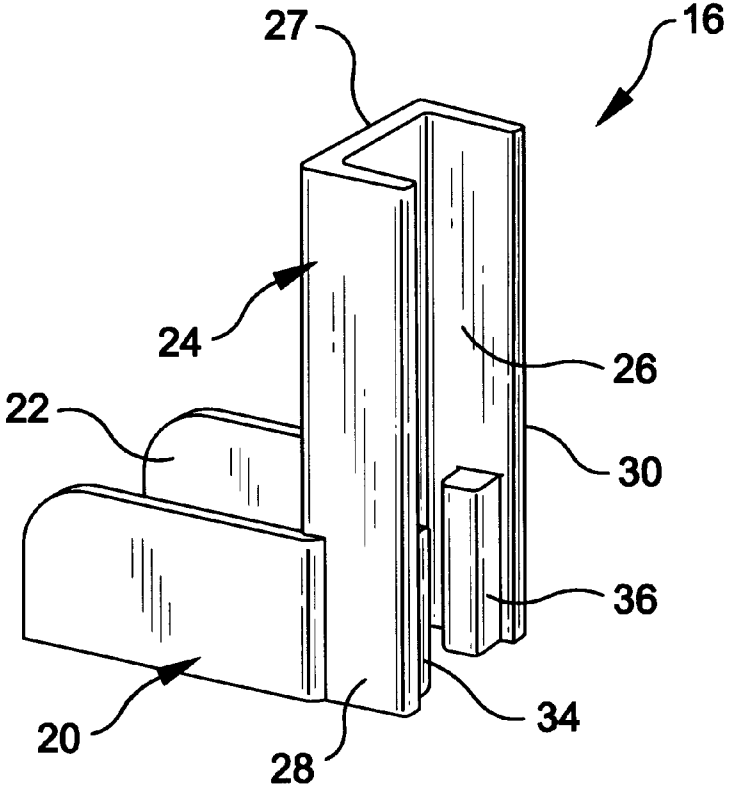
FIG. 6 is a top perspective view thereof.
Figure 8:
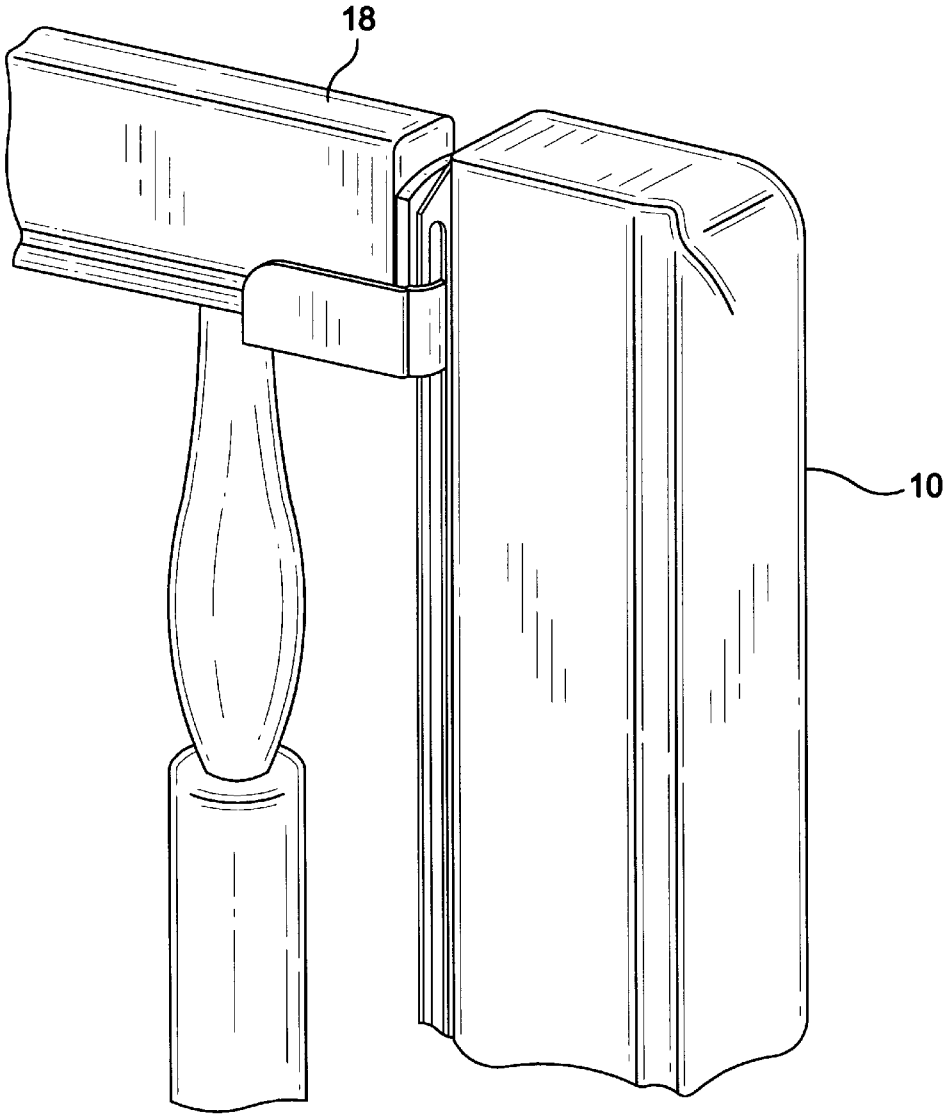
FIG-8 PRIOR ART
FIG. 8 is a perspective view of a crib dropside assembly known to the art.

As shown in FIG. 7, end fittings known to the art have included a base from which a pair of L-shaped arms extend. The end fitting are molded from a durable plastic material. When such end fittings engage a track, as shown in FIG. 8, a gap is formed between the corner post and the end fitting. This gap is substantially eliminated in accordance with the invention.

Figure 4:
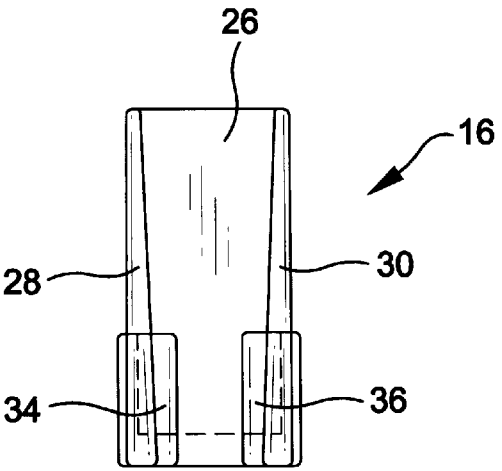
FIG. 4 is a front end view of an end fitting according to the invention.

A novel end fitting 16 is provided which includes a base 20 defining a first channel 22. A shield 24 extends from the base and defines a second channel 26 oriented substantially perpendicularly to the first channel. The second channel is defined by a first wall 27 coupled to the base and a pair of opposing walls 28,30 coupled to the first wall. The opposing walls have inner ends adjoining the first wall and outer ends defining the depth of the second channel. First and second projections 34,36 extend within the second channel from the opposing walls of the shield. The projections are in opposing relation and are located between the inner and outer ends of the opposing walls 28,30. Each of the projections is elongated in the direction of the second channel. The length of the second channel is substantially greater than the depth of the first channel. In a preferred embodiment of the invention, the length of the second channel is about two inches, while the depth of the first channel is about five eighths of an inch. The length of each of the projections is preferably about the same as the depth of the channel. The projections are aligned with the base portion of the end fitting to provide satisfactory strength. The opposing walls are preferably thicker near the projections than at the opposite end of the second channel, as best shown in FIG. 4.

Figure 2:
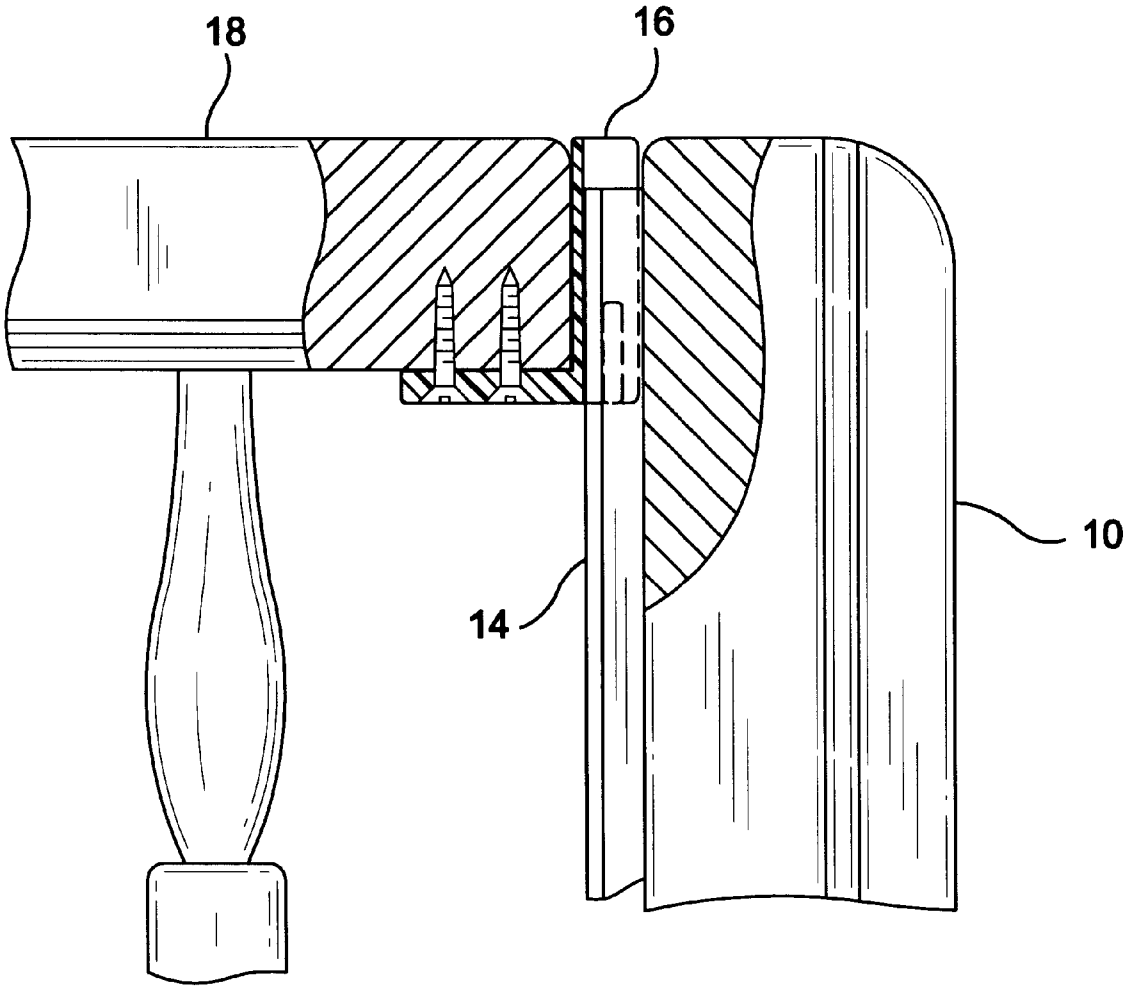
FIG. 2 is a partial sectional view thereof.

In use, the end fittings 16 are secured to the bottom portions of each end of the upper rail of the dropside 12. The dimensions of the first channel 22 of each end fitting are such that the bottom end portions of the upper rail fit therein. Screws are employed for securing the end fittings to the upper rail of the dropside, as shown in FIG. 2.

Figure 3:
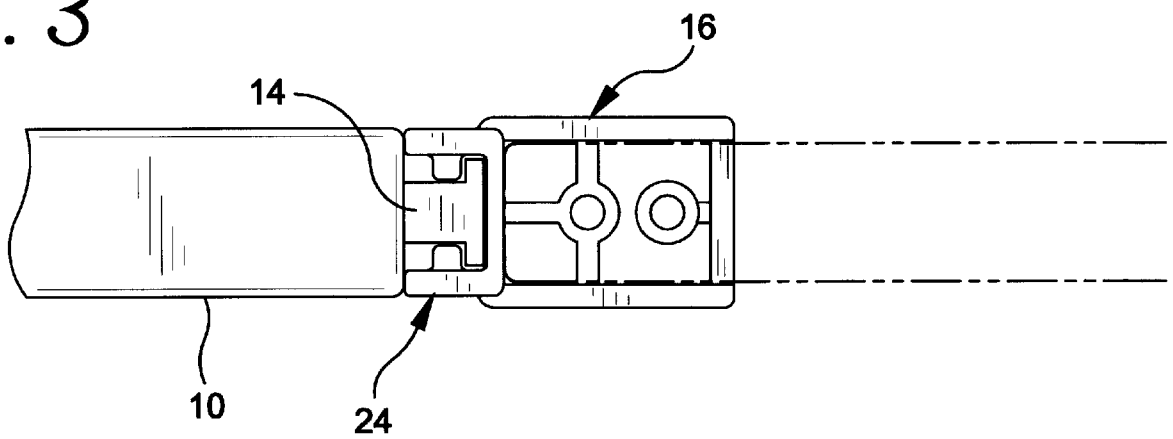
FIG. 3 is a partial bottom plan view thereof.
Figure 5:
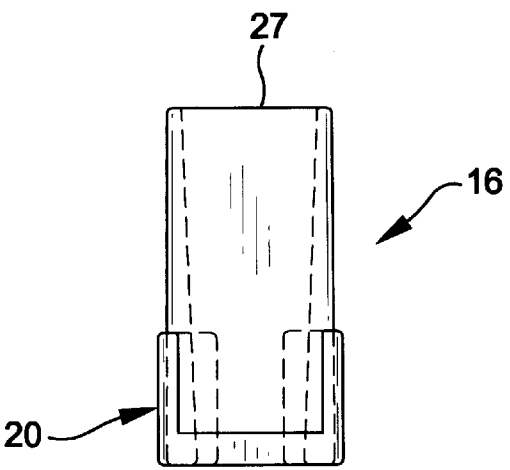
FIG. 5 is a rear end view thereof.

The first wall 27 of each end fitting adjoins an end surface of the upper rail of the dropside. The depth of the second channel 26 is such that the outer end surfaces of the opposing walls 28,30 adjoin or abut the inner surfaces of the corner post 10, leaving substantially no gap in which clothing or bedding can enter. As shown in FIG. 3, the flat rail of the track 14 is positioned between the projections 34,36 and the first wall 27. The dropside can be easily moved between raised and lowered positions as the end fittings slide along the tracks.

What is claimed is:

1. A crib dropside assembly comprising:

a corner post;

a dropside movably mounted to said corner post, said dropside including an upper rail;

an end fitting mounted to a first end of said upper rail of said dropside, said end fitting including a track engagement member;

a track coupled to said corner post, said track engagement member being slidably mounted to said track, and a shielding member coupled to said end fitting, said shielding member enclosing said track engagement member and adjoining said corner post such that substantially no gap is present between said end fitting and said corner post.

2. A crib dropside assembly as described in claim 1 wherein said track includes a substantially flat rail located outside said corner post, and said shielding member encloses a portion of said flat rail.

3. A crib dropside assembly as described in claim 2 wherein said shielding member is comprised of a pair of opposing walls, and said track engagement member is comprised of a pair of opposing projections extending inwardly from said opposing walls.

4. A crib dropside assembly as described in claim 3 wherein said end fitting and said shielding member are of integral construction.

5. A crib dropside assembly as described in claim 4 wherein said end fitting includes a base comprising a bottom wall and a pair of opposing side walls extending upwardly from said bottom wall, said bottom wall and opposing side walls defining a channel, said upper rail being positioned at least partially within said channel.

6. A crib dropside assembly as described in claim 1 wherein said end fitting includes a base defining a first channel, said shielding member comprising first and second opposing walls secured to said base and defining a second channel enclosing at least a portion of said track engagement member, said first channel enclosing a portion of said upper rail.

7. A crib dropside assembly as described in claim 6 wherein said track engagement member includes projections extending inwardly from said opposing walls of said shielding member.

8. A crib dropside assembly as described in claim 7 wherein said track includes a substantially flat rail located outside said corner post, and said shielding member encloses said flat rail.

9. A crib dropside assembly as described in claim 7 wherein said opposing walls include edge portions adjoining said corner post, said projections being positioned inwardly of said edge portions.

10. A crib dropside assembly as described in claim 9 wherein said projections are located in proximity to said base, said projections being elongate and including lower ends and upper ends, said opposing walls extending upwardly substantially beyond the upper ends of said projections.

11. A crib dropside assembly as described in claim 10 wherein said opposing walls include relatively thick portions near said projections and relatively thin portions above said projections.

12. A crib dropside assembly comprising:

a corner post;

a track coupled to said corner post;

a dropside, said dropside including an upper rail;

an end fitting mounted to a first end of said upper rail of said dropside, said end fitting including a base defining a first channel, a shield integral with said base and defining a second channel, said shield including a first wall extending perpendicularly with respect to said first channel and a pair of opposing walls having inner ends integral with said first wall and outer ends abutting said corner post, first and second projections extending within said second channel from said opposing walls of said shield, said projections being in opposing relation to each other, said second channel having a length which is substantially greater than the depth of said first channel, said projections being aligned with said base, said upper rail being positioned at least partially within said first channel and secured to said base, said track including a portion slidably positioned between said first wall and said first and second projections.

13. A crib dropside assembly as described in claim 12 wherein each of said first and second projections has a length which is about the same as the depth of said first channel and is positioned inwardly of said outer ends of said opposing walls.

14. A crib dropside assembly as described in claim 12 wherein said opposing walls include relatively thick portions near said projections and relatively thin portions above said projections.

* * * * *